US005809381A

United States Patent [19]

Kimura

[11] Patent Number: 5,809,381

[45] Date of Patent: Sep. 15, 1998

[54] IMAGE-FORMING APPARATUS AND MAGNIFICATION CORRECTION METHOD USING THE SAME

[75] Inventor: Kazumi Kimura, Toda, Japan

[73] Assignee: Canon Kabushiki Kaisha, Tokyo, Japan

[21] Appl. No.: 777,093

[22] Filed: Dec. 30, 1996

[30] Foreign Application Priority Data

Jan. 6, 1996 [JP] Japan ..... 8-017135

[51] Int. Cl.[6] ..... G03G 15/04; G03B 27/34

[52] U.S. Cl. ..... 399/196; 355/55; 399/201

[58] Field of Search ..... 399/196, 197, 399/200, 201, 202, 36, 38; 206/316.1; 359/12; 355/55, 56, 61

[56] References Cited

U.S. PATENT DOCUMENTS

| | | | |
|---|---|---|---|
| 4,095,880 | 6/1978 | Shogren et al. | 399/200 |
| 4,367,038 | 1/1983 | Hisabayoshi et al. | 399/196 X |
| 4,497,573 | 2/1985 | Tokuhara et al. | 355/58 |
| 4,582,418 | 4/1986 | Kozuka et al. | 399/201 X |
| 4,956,672 | 9/1990 | Shibazaki et al. | 399/197 |
| 5,113,218 | 5/1992 | Morikawa et al. | 355/56 |
| 5,117,256 | 5/1992 | Haibara | 355/55 X |
| 5,369,465 | 11/1994 | Kuwahara | 355/55 X |
| 5,450,175 | 9/1995 | Sato et al. | 399/201 |

FOREIGN PATENT DOCUMENTS

| | | |
|---|---|---|
| 61-80140 | 4/1986 | Japan . |
| 61-172134 | 8/1986 | Japan . |
| 4348334 | 12/1992 | Japan . |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

An image-forming apparatus includes an image-forming unit for image-forming image information of an original on a record medium, an optical-path-length varying unit for varying a distance between an object and an image, a driving unit for driving the image-forming unit and the optical-path-length varying unit in an interlocking manner such that the image information of the original is formed on the record medium at a plurality of magnifications, and a control unit for controlling the driving unit. In the structure, the image-forming unit and the optical-path-length varying unit are mounted to the driving unit such that the positions of the image-forming unit and the optical-path-length varying unit are adjustable relative to the driving unit. An appropriate magnification is obtained even if a focal length of the fixed-focus image-forming lens fluctuates due to errors occurring during its manufacturing process.

7 Claims, 7 Drawing Sheets

MAGNIFICATION DEVIATION (NOT ADJUSTED)

MAGNIFICATION DEVIATION (AFTER ADJUSTED)

IMAGE-FORMING APPARATUS AND MAGNIFICATION CORRECTION METHOD USING THE SAME

BACKGROUND OF THE INVENTION

1. Field of the Invention

The present invention relates to an image-forming apparatus and a magnification correction method using the image-forming apparatus. In particular, the present invention relates to an art in which a predetermined magnification (a set magnification) and an actual magnification are substantially coincident with each other and an accuracy of the magnification is improved by using a correction means or a correction method for obtaining an appropriate magnification even if a focal length, or the like, of a fixed-focus image-forming lens for forming image information on a record medium fluctuates due to errors occurring during its manufacturing process.

2. Related Background Art

FIG. 1 illustrates a main portion of a conventional copying machine or an image-forming apparatus with a variable power optical system for varying the magnification. In FIG. 1, reference numeral 191 denotes a glass plate for supporting an original, and an original (not shown) is put on the glass plate 191. Reference numeral 151 denotes a first mirror unit or a full-speed mirror unit, and the first mirror unit 151 includes a light source or a lamp 151*a*, light condensing means or shell-shaped reflectors 151*b*, a path-bending mirror 151*c*, etc. Reference numeral 161 denotes a second mirror unit or a half-speed mirror unit, and the second mirror unit 161 includes two path-bending mirrors 161*a* and 161*b*. A ratio between scan speeds of the first and second mirror units 151 and 161 is 2:1, and those mirror units 151 and 161 are moved in a horizontal or sub-scan direction relative to the glass plate 191 to scan the entire range of the original. Reference numeral 100 denotes a fixed-focus image-forming lens which acts as an image-forming means, and the lens 100 image-forms image information of the original on a photosensitive drum 181, which acts as an image carrier, at a predetermined magnification. Reference numeral 141 denotes a zoom-mirror unit or an optical-path-length varying means for varying the distance between an object and an image, and the zoom-mirror unit 141 includes two path-bending mirrors 141*a* and 141*b*. Reference numeral 171 denotes a path-bending mirror. Reference numerals 143 and 144 are respectively driving means or variable power driving systems, and those driving systems 143 and 144 respectively drive the image-forming lens 100 and the zoom-mirror unit 141 to positions corresponding to a desired magnification, on the basis of signals supplied from a driver control means (CPU) 142.

In FIG. 1, illumination light from the light source 151*a* is condensed by the light-condensing means 151*b* and illuminates the original put on the glass plate 191. The optical path of image information of the illuminated original is bent by the path-bending mirrors 151*c*, 161*a* and 161*b*, and the image information is image-formed on the photosensitive drum 181, through the path-bending mirrors 141*a*, 141*b* and 171, by the image-forming lens 100. The image of the image information of the original formed on the photosensitive drum 181 is transferred to a copying paper using a well-known electrophotographic process (not shown).

When the image information of the original is to be copied at a desired magnification in the above-discussed copying machine or image-forming apparatus, the image-forming lens 100 and the zoom-mirror unit 141 are moved to positions corresponding to the desired magnification, by the respective driving means or variable power driving systems 143 and 144 which are controlled by the driver control means 142. For example, when the magnification is to be changed from one-to-one magnification to a magnification of m, movement amounts x and y of the image-forming lens 100 and the zoom-mirror unit 141 can be obtained by the following manner.

With a length between principal planes of the image-forming lens 100 and defocus characteristics being disregarded, the movement amount $x_m$ of the image-forming lens 100 is given by:

$$x_m=f(1/m-1) \tag{1}$$

The change amount $y_m$ of the optical path length in this case is represented by:

$$y_m=f(m+1/m-2)=(x_m-f+f^2/(x_m+f)) \tag{2}$$

f: focal length (design value) of the image-forming lens m (m>0): image-forming magnification The distance between the original surface and the front principal plane of the image-forming lens 100 is given by:

$$a=f(1/m+1)=2f+x_m \tag{3}$$

The distance between the light reception surface and the rear principal plane of the image-forming lens 100 is given by:

$$b=f(m+1)=2f-x_m+y_m \tag{4}$$

The structure of the copying machine is designed such that the positions of the image-forming lens 100 and the zoom-mirror unit 141 on the optical axis are moved by predetermined amounts in accordance with the above relations (1) and (2) when the magnification is a desired value of m.

In the conventional copying machine or image-forming apparatus with the variable power optical system, however, the following problems occur.

For example, there is a problem that the focal length of the image-forming lens, whose focal length is designed at f, is liable to fluctuate from the design value f by several percent due to the index of employed glass material, ground surface precision of the lens surface, central thickness of the lens, intervals between the lenses and the like. Due to the fluctuation of the focal length f, deviation of a magnification from the set magnification occurs as follows.

It is assumed that an actual focal length f' of the image-forming lens is f'=kf due to the errors during the manufacturing process. In this case, when adjustments of focussing and magnification are executed at a one-to-one magnification, the following relation is obtained:

$$a'=2f'=b'$$

When the structure is instructed to obtain the magnification of m and the optical systems are displaced, the following relations are established:

$$a_m'=2f'+x \tag{5}$$

$$b_m'=2f'-x+y \quad (6)$$

At this moment, the actual magnification m' of the structure Is represented by:

$$m'=\frac{b_m'}{a_m'}=\frac{2f'+(m-1)f}{2f'+(1/m-1)f}=\frac{2f'+f^2/(x+f)-f}{2f'+x} \quad (7)$$

A difference or magnification deviation z between the predetermined magnification (set magnification) m and the actual magnification m' is then given by:

$$z=(m'/m-1)\times 100(\%)$$

This is illustrated in FIG. 2. As is known therefrom, the magnification deviation is considerably large at some set magnifications m.

Means for correcting the magnification deviation is disclosed, for example, in Japanese Patent Application Laid-Open Nos. 4-348334, 61-80140 and 61-172134.

In the structure of Japanese Patent Application Laid-Open No. 4-348334, the variable power recording is performed by moving a fixed-focus projection lens and a variable power mirror for changing an optical path length by respective driving means. In this structure, fluctuation of the focal length of the projection lens is considered, and the factual focal length of the projection lens is measured. On the basis of the measured result, corrected positions of the projection lens and the variable power mirror are determined. At the time of varying the magnification, displacement positions of the projection lens and the variable power mirror are corrected.

In the structure of Japanese Patent Application Laid-Open No. 4-348334, however, separate driving systems for driving the projection lens and the optical-path-length varying means are individually needed, and hence, problems, such as an increase in size of the entire apparatus, an increase in cost and an increase in weight of the apparatus, newly occur.

Further, in the structure of Japanese Patent Application Laid-Open No. 4-348334, the factual focal length of the projection lens needs to be measured, and thus adjustment operation therefor is burdensome.

In the structure of Japanese Patent Application Laid-Open No. 61-80140, a swinging cam having a specific shape is used, and a fixed-focus projection lens and a variable power mirror for varying an optical path length are moved in an interlocking manner to perform the variable power recording. Further, tolerance of the focal length of the projection lens is assumed to be about ±1%, and the tolerance is compensated for by adjusting the position and shape of the swinging cam.

In the structure of Japanese Patent Application Laid-Open No. 61-80140, however, the swinging cam of a specific shape is needed, and the positional adjustment of the swinging cam is very troublesome.

Further, in the structure of Japanese Patent Application Laid-Open No. 61-80140, since the adjustment is performed by the swinging cam only, so that a range of fluctuation of the focal length to be corrected is limited.

In the structure of Japanese Patent Application Laid-Open No. 61-172134, a cam is used, and a fixed-focus projection lens and a variable power mirror for varying an optical path length are moved in an interlocking manner to perform the variable power recording. When there is a fluctuation in the focal length of the projection lens, the positional posture of the cam is adjusted to compensate for the fluctuation.

In the structure of Japanese Patent Application Laid-Open No. 61-172134, however, the focal length of the used projection lens is measured, the optical path length is corrected at the time of a one-to-one magnification to attain a focused state, and at the same time, the positional posture of the cam is adjusted in accordance with the fluctuation of the focal length.

In such an adjustment method, the focal length of the used projection lens needs to be measured, and the adjustment operation of the positional posture of the cam requires a troublesome work.

SUMMARY OF THE INVENTION

It is an object of the present invention to provide an image-forming apparatus and a magnification correction method using this apparatus in which a predetermined magnification (a set magnification) and an actual magnification are made substantially coincident with each other and an accuracy of the magnification is improved by using a correction means or a correction method for obtaining an appropriate magnification even if a focal length of a fixed-focus image-forming lens fluctuates due to errors occurring during its manufacturing process.

According to one aspect of the present invention, there is provided an image-forming apparatus which includes an image-forming unit for image-forming image information of an original on a record medium, an optical-path-length varying unit for varying a distance between an object and an image, a driving unit for driving the image-forming unit and the optical-path-length varying unit in an interlocking manner such that the image information of the original is formed on the record medium at a plurality of magnifications, and a control unit for controlling the driving unit. In the structure, positions of the image-forming unit and the optical-path-length varying unit are adjustable relative to the driving unit.

Specifically, there are preferably further arranged a coupling portion between the driving unit and the image-forming unit or the optical-path-length varying unit and an indicator for positional adjustment therebetween provided on the coupling portion.

According to another aspect of the present invention, there is provided an image-forming apparatus which includes an image-forming unit for image-forming image information of an original on a record medium, an optical-path-length varying unit for varying a distance between an object and an image, a driving unit for driving the image-forming unit and the optical-path-length varying unit in an interlocking manner such that the image information of the original is formed on the record medium at a plurality of magnifications, a detecting unit for detecting a change in a relative position between the driving unit and the image-forming unit or the optical-path-length varying unit, and a control unit for controlling the driving unit on the basis of a detection result of the detecting unit. In the structure, positions of the image-forming unit and the optical-path-length varying unit are adjustable relative to the driving unit.

According to another aspect of the present invention, there is provided an image-forming apparatus which includes an image-forming unit for image-forming image information of an original on a record medium, an optical-path-length varying unit for varying a distance between an object and an image, a driving unit for driving the image-forming unit and the optical-path-length varying unit in an interlocking manner such that the image information of the original is formed on the record medium at a plurality of magnifications, and a control unit for controlling the driving unit on the basis of a change in a relative position between the driving unit and the image-forming unit or the optical-path-length unit. In the structure, positions of the image-forming unit and the optical-path-length varying unit are adjustable relative to the driving unit.

According to another aspect of the present invention, there is provided a magnification correction method to be performed in an image-forming apparatus, which includes a step of driving a fixed-focus image-forming unit and an optical-path-length varying unit in an interlocking manner by a common driving unit such that image information of an original is formed on a record medium at a plurality of magnifications, a step of adjusting positions of the image-forming unit and the optical-path length unit relative to the driving unit, a step of detecting a change in a relative position between the driving unit and the image-forming unit or the optical-path-length varying unit, and a step of controlling the driving unit on the basis of the change detected in the detecting step.

According to still another aspect of the present invention, there is provided a magnification correction method to be performed in an image-forming apparatus, which includes a step of driving a fixed-focus image-forming unit and an optical-path-length varying unit in an interlocking manner by a common driving unit such that image information of an original is formed on a record medium at a plurality of magnifications, a step of adjusting positions of the image-forming unit and the optical-path length unit relative to the driving unit, and a step of controlling the driving unit on the basis of a change in a relative position between the driving unit and the image-forming unit or the optical-path-length varying unit.

According to yet another aspect of the present invention, there is provided an image-forming apparatus which includes an image-forming unit for image-forming image information of an original on a record medium and an optical-path-length varying unit for varying a distance between an object and an image, and in which positions of the image-forming unit and the optical-path-length varying unit are adapted to be changed such that the image information of the original is formed on the record-medium at a plurality of magnifications. This image-forming apparatus is characterized by a driving unit for driving the image-forming unit and the optical-path-length varying unit in an interlocking manner, a fine adjustment unit for finely adjusting mounted positions of the image-forming unit and the optical-path-length varying unit relative to the driving unit, along the optical axis, a detecting unit for detecting an adjustment amount of the fine adjustment by the fine adjustment unit, an input unit for inputting the adjustment amount detected by the detecting unit, and a determining unit for determining a drive amount of driving by the driving unit on the basis of the adjustment amount input by the input unit.

Specifically, at coupling portions for coupling the image-forming unit and the driving unit to each other, a reference indicator in respect of the adjustment amount is provided on one of the coupling portions and division indicators in respect of the adjustment amount are provided on the other. An interval D of the divisions is set as:

$$D=f\times N/M$$

f: focal length of the fixed-focus image-forming unit

N, M: integers (N<M)

Further, there may be further arranged a position detecting unit for detecting a relative position between the image-forming unit and the driving unit, and the adjustment amount of the fine adjustment unit may be calculated by an operation unit on the basis of the output value from the position detecting unit.

Furthermore, the determining unit determines a corrected drive amount $x_m'$ relative to a predetermined drive amount of the image-forming unit at the time of a desired magnification, from the following relation.

The corrected drive amount of the image-forming unit at a predetermined magnification (the drive amount from a one-to-one magnification to a magnification of m) is given by:

$$x_m'=S_m X_m$$

$x_m$: drive amount from a one-to-one magnification to a magnification of m $$S_m=\frac{2k(1-m)-(m+1)+\sqrt{(2k-1)^2(m-1)^2+4m}}{2(1-m)}$$

$$k=(L+\Delta L)/L$$

$$L=2\times f$$

ΔL=difference in relative position between the image-forming unit and the driving unit from a design value f=focal length of the fixed-focus image-forming unit According to yet another aspect of the present invention, there is provided a magnification correction method in which, when a magnification is varied to a desired magnification by varying positions of an image-forming unit for image-forming image information of an original on a record medium and an optical-path-length varying unit for varying a distance between an object and an image, the image-forming unit and the optical-path-length varying unit are respectively driven to positions of a predetermined magnification by a driving unit for driving the image-forming unit and the optical-path-length varying unit, the positions of the image-forming unit and the optical-path-length unit relative to the driving unit are finely adjusted by a fine adjustment unit such that the conditions of the predetermined magnification and focussing are satisfied, a relative adjustment amount between the driving unit and the image-forming unit or the optical-path-length unit subsequent to the fine adjustment is detected by a detecting unit, and a corrected drive amount relative to a predetermined drive amount at the time of a desired magnification is determined by a determining unit on the basis of the detected adjustment amount.

Specifically, the determining unit determines the corrected drive amount relative to the predetermined drive amount of the image-forming unit at the time of a desired magnification, from the following relation.

The corrected drive amount of the image-forming unit at a predetermined magnification (the drive amount from a one-to-one magnification to a magnification of m) is given by:

$$x_m'=S_m x_m$$

$x_m$: drive amount from a one-to-one magnification to a magnification of m $$S_m = \frac{2k(1-m)-(m+1)+\sqrt{(2k-1)^2(m-1)^2+4m}}{2(1-m)}$$

$$k=(L+\Delta L)/L$$

$$L=2\times f$$

ΔL=difference in relative position between the image-forming unit and the driving unit from a design value f=focal length of the fixed-focus image-forming unit According to yet another aspect of the present invention, there is provided an image-forming apparatus which includes an image-forming unit for image-forming image information of an original on a record medium and an optical-path-length varying unit for varying a distance between an object and an image, and in which positions of the image-forming unit and the optical-path-length varying unit are adapted to be changed such that the image information of the original is formed on the record medium at a plurality of magnifications. This image-forming apparatus is characterized by a driving unit for driving the image-forming unit and the optical-path-length varying unit in an interlocking manner to positions of a desired magnification, a fine adjustment unit for finely adjusting positions of the image-forming unit and the optical-path-length varying unit relative to the driving unit, a detecting unit for detecting an adjustment amount of the fine adjustment by the fine adjustment unit, an input unit for inputting the adjustment amount detected by the detecting unit, a determining unit for determining a drive amount of the driving unit on the basis of the adjustment amount input by the input unit, and a recording unit for recording data of the drive amount determined by the determining unit.

Specifically, at coupling portions for coupling the image-forming unit and the driving unit to each other, a reference indicator with respect to the adjustment amount is provided on one of the coupling portions and division indicators with respect to the adjustment amount are provided on the other. An interval D of the divisions is set as:

$$D=f\times N/M$$

f: focal length of the fixed-focus image-forming unit

N, M: integers (N<M)

Further, the determining unit determines a corrected drive amount relative to a predetermined drive amount of the image-forming unit at the time of a desired magnification, from the following relation.

The corrected drive amount of the image-forming unit at a predetermined magnification (the drive amount from a one-to-one magnification to a magnification of m) is given by:

$$x_m'=S_m x_m$$

$x_m$: drive amount from a one-to-one magnification to a magnification of m $$S_m = \frac{2k(1-m)-(m+1)+\sqrt{(2k-1)^2(m-1)^2+4m}}{2(1-m)}$$

$$k=(L+\Delta L)/L$$

$$L=2\times f$$

ΔL-difference Zin relative position between the image-forming unit and the driving unit from a design value f=focal length of the fixed-focus image-forming unit

DETAILED DESCRIPTION OF THE PREFERRED EMBODIMENTS

Figure 3:
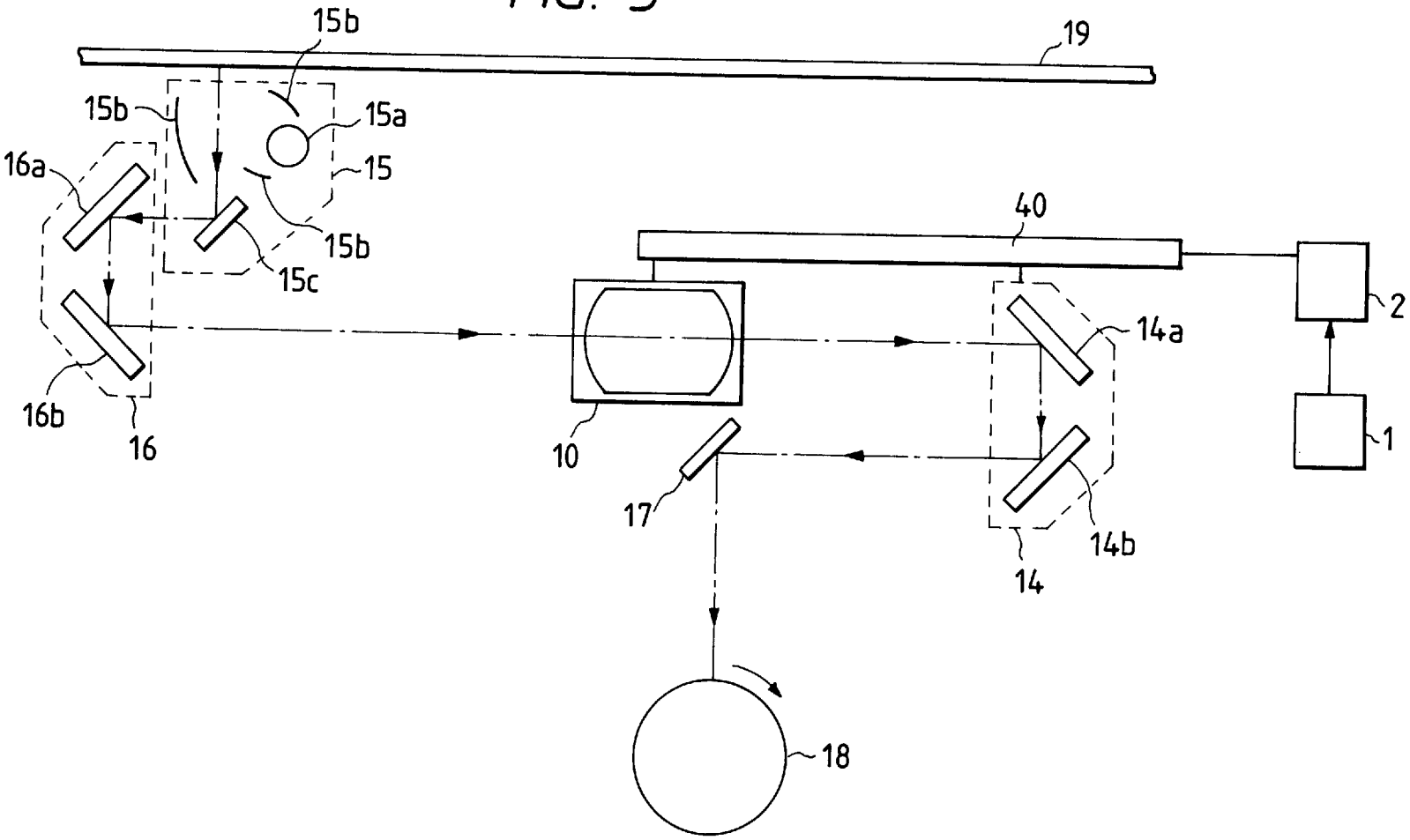
FIG. 3 is a view illustrating a main portion of a first embodiment of an image-forming apparatus according to the present invention.

A first embodiment of an image-forming apparatus is shown in FIG. 3. In FIG. 3, reference numeral 19 denotes a glass plate for supporting an original, and the original (not shown) is put on the glass plate 19. Reference numeral 15 denotes a first mirror unit or a full-speed mirror unit, and the first mirror unit 15 includes a light source or a lamp 15*a*, light condensing means or shell-shaped reflectors 15*b*, a path-bending mirror-15*c*, etc. Reference numeral 16 denotes a second mirror unit or a half-speed mirror unit, and the second mirror unit 16 includes two path-bending mirrors 16*a* and 16*b*. A ratio between scan speeds of the first and second mirror units 15 and 16 is 2:1, and those mirror units 15 and 16 are moved in a horizontal or sub-scan direction relative to the glass plate 19 and scan the entire range of the original.

Reference numeral 10 denotes a fixed-focus image-forming lens (a variable power optical system) which acts as an image-forming means or unit, and the lens 10 image-forms image information of the original on a photosensitive drum 18, which acts as a record medium, at a predetermined magnification. Reference numeral 14 denotes a zoom-mirror unit or an optical-path-length varying means for varying the distance between an object and an image, and the zoom-mirror unit 14 includes two path-bending mirrors 14*a* and 14*b*. Reference numeral 17 denotes a path-bending mirror. Reference numeral 18 denotes the above-discussed photosensitive drum which acts as a record medium or an image carrier, and the drum 18 is rotated in a predetermined direction (the sub-scan direction) at a constant speed.

Reference numeral 40 denotes a driving means or a variable power driving system, and the system 40 interlocks the image-forming lens 10 and the zoom-mirror unit 14 with each other. When the magnification is to be varied, the driving system 40 drives the image-forming lens 10 and the zoom-mirror unit 14 to positions corresponding to a desired magnification, on the basis of signals supplied from a driver control means (CPU) 2.

Reference numeral 1 denotes an adjustment-amount input means or input means which supplies an adjustment amount of fine adjustment by a fine adjustment means. When performing focussing adjustment and magnification adjustment, the fine adjustment means finely adjusts the positions of the image-forming lens 10 and the zoom-mirror unit 14 relative to the driving means 40 such that the predetermined magnification and focussing are satisfied.

The driver control means 2 not only controls the driving means 40, but also acts as a determining means for determining a corrected drive amount relative to a predetermined drive amount at the time of a desired magnification for the driving means 40, on the basis of the adjustment amount input from the adjustment-amount input means 1. The corrected drive amount is a drive amount for each of the image-forming lens 10 and the zoom-mirror unit 14 which is suited for an actual focal length f'.

In this embodiment, illumination light from the light source 15*a* is condensed by the light-condensing means 15*b* and illuminates the original put on the glass plate 19. The optical path of image information of the illuminated original is bent by the path-bending mirrors 15*c*, 16*a* and 16*b*, and the image information is image-formed on the photosensitive drum 18, through the path-bending mirrors 14*a*, 14*b* and 17, by the image-forming lens 10. The image of the image information of the original formed on the photosensitive drum 18 is transferred to a copying paper using a well-known electrophotographic process (not shown).

When the image information of the original is to be copied at a desired magnification in this embodiment, the image-forming lens 10 and the zoom-mirror unit 14 are moved to positions corresponding to the desired magnification, by the driving means or variable power driving system 40 which is controlled by the driver control means 2. For example, when the magnification is to be changed from a one-to-one magnification to a magnification of m, movement amounts $x_m$ and $y_m$ (design values) of the image-forming lens 10 and the zoom-mirror unit 14 can be obtained by the following manner.

With a length between principal planes of the image-forming lens 10 and defocus characteristics being disregarded, the movement amount $x_m$ of the image-forming lens 10 at the time of changing from a one-to-one magnification to a magnification of m is given by:

$$x_m=f(1/m-1) \tag{1}$$

The change amount $y_m$ of the optical path length in this case is represented by:

$$y_m=f(m+1/m-2)=x_m-f+f^2/(x_m+f)) \tag{2}$$

f: focal length (design value) of the image-forming lens m (m>0): image-forming magnification The distance between the original surface and the front principal plane of the image-forming lens 10 is given by:

$$a=f(1/m+1)=2f+x_m \tag{3}$$

The distance between the light reception surface and the rear principal plane of the image-forming lens 10 is given by:

$$b=f(m+1)=2f-x_m+y_m \tag{4}$$

The structure of the copying machine of this embodiment is designed such that positions of the fixed-focus image-forming lens 10 and the zoom-mirror unit 14 on the optical axis are moved by predetermined amounts by the driving means in accordance with the above relations (1) and (2) when the magnification is a desired value of m.

Figure 4:
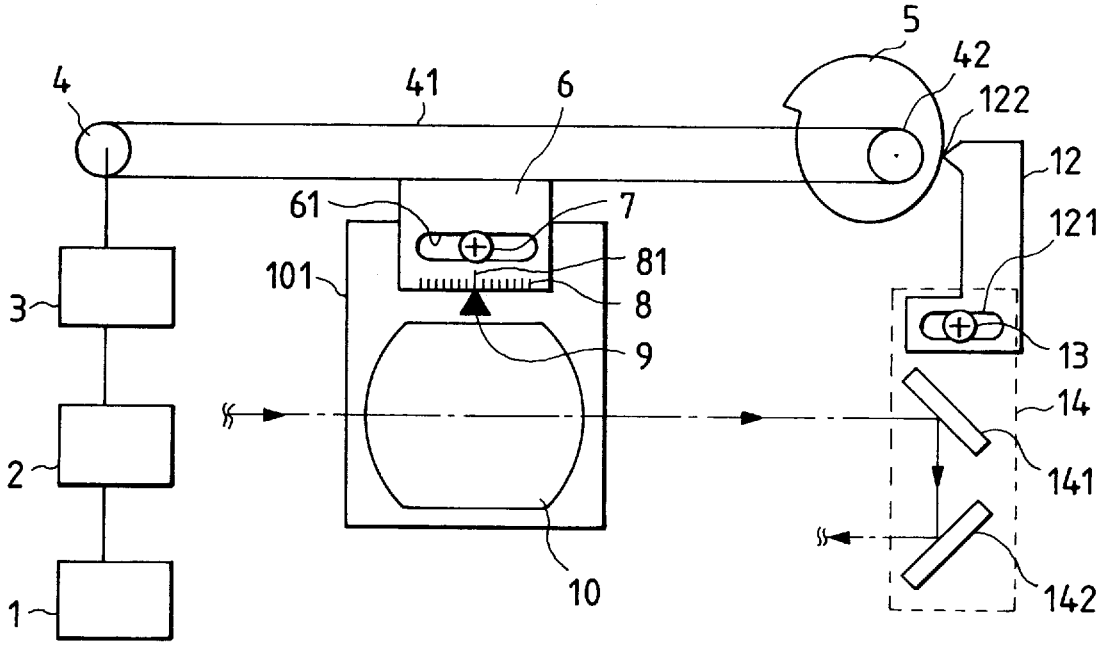
FIG. 4 is a detailed view illustrating a variable power optical system of the first and second embodiments.

FIG. 4 illustrates the variable power optical system of this embodiment. In FIG. 4, the same elements as those in FIG. 3 are designated by the same numbers.

In FIG. 4, reference numeral 3 denotes a driving source or a pulse motor, reference numerals 4 and 42 respectively denote pulleys, reference numeral 41 denotes a wire, reference numeral 6 denotes a connecting plate, reference numeral 5 denotes an eccentric cam, and reference numeral 12 denotes a cam follower. Those elements constitute a portion of the driving means. In this embodiment, the pulley 4 is rotated by the driving means 3 and the pulley 42 is rotated by the wire 41 rotated by the pulley 4. The eccentric cam 5 is rotated together with the pulley 42, and has a shape represented by polar coordinates ($r_m$, $\theta_m$) with an axis of the rotational axis.

$$\begin{aligned} r_m &= r_0 + y_m/2 \\ &= r_0 + 1/2 \cdot f(m + 1/m - 2) \\ &= r_0 + 1/2(x_m - f + f^2/(x_m + f)) \\ \theta_m &= x_m/\pi r_1 \text{ [rad]} \\ &= 1/\pi r_1 \cdot f(1/m - 1) \end{aligned}$$

$r_0$: constant $r_1$: radius of the pulley 42

The cam follower 12 is in contact with the eccentric cam 5 at a point 122 of contact, and is constructed such that the contact point 122 is always in contact with the eccentric cam 5 when the cam 5 is rotated. For example, the cam follower 12 is urged against the eccentric cam 5 by a spring force. Further, the cam follower 12 has an elongate hole 121, and is fixed to the zoom-mirror unit 14 including mirrors 141 and 142 by a lock pin or a set screw 13.

The connecting plate 6 connects the wire 41 to the image-forming means 10, and is fixed to the wire 41. The connecting plate 6 has an elongate hole 61, and is fixed to a lens unit frame 101 by a set screw 7. Divisions 8 for indicating the adjustment amount are provided on the connecting plate 6. The image-forming lens 10 is fixed to the lens unit frame 101, and a reference indicator 9 relevant to the adjustment amount is provided on the frame 101.

The above-discussed set screws 7 and 13 constitute a portion of the fine adjustment means. The positions of the image-forming lens 10 and the zoom-mirror unit 14 can be finely adjusted along the optical axis by unscrewing the set screws 7 and 13, respectively. At this time, a detecting means (described later) detects the displacement amounts of the adjusted image-forming lens 10 and the zoom-mirror unit 14 relative to the design values. Thus, the actual focal length f' can be predicted.

In this embodiment, the division indicators 8 are provided on the connecting plate 6, and the reference indicator 9 is provided on the lens unit frame 101, as discussed above. An interval D of the divisions is set as:

$$D=f\times N/M$$

f: focal length of the image-forming means

N, M: integers (N<M)

The divisions at the interval D can be known by a ratio k (=f'/f) between the actual focal length f' and the design focal length f.

In this embodiment, the divisions are formed at the intervals of 0.002 f (N=2, M=1000). In this case, the distance from the image-forming lens 10 to the original surface is 2 f at the time of a one-to-one magnification, for example. Hence, one division indicates that the actual focal length f' is varied by 0.1% in comparison with the design focal length f.

The division indicators 8 and the reference indicator 9 constitute a portion of the detecting means for detecting the adjustment amount of the fine adjustment by the fine adjustment means. As discussed above, the adjustment amount, by which the fine adjustment means executes the fine adjustment, can be detected from the relative relationship between those two indicators.

In this embodiment, when the driving means 40 is driven to a position of a one-to-one magnification, the eccentric cam 5 and the connecting plate 6 are driven to predetermined positions on the basis of signals from the driver control means 2 and thus the image-forming lens 10 and the mirror unit 14 are driven accordingly. At this time, a center division 81 is the division at which the image-forming lens 10 having an exact focal length of the design value satisfies conditions of the magnification (in this case, one-to-one magnification) and the focussing.

An adjustment method for varying the magnification of this embodiment will be described.

Initially, the image-forming lens 10 and the mirror unit 14 are respectively fixed to the driving means.

The driving source 3 is then driven by the driver control means 2, and the connecting plate 6 and the eccentric cam 12 are moved to the arrangement at the time of a one-to-one magnification. Then, the set screws 7 and 13 are respectively unscrewed and the positions of the image-forming lens 10 and the zoom-mirror unit 14 are finely adjusted along the optical axis. The respective screws 7 and 13 are tightened at places where the conditions of magnification and focussing are satisfied.

Then, a place of the division indicators 8 indicated by the reference indicator 9 is read by a CCD camera or the like. For example, when the reference indicator 9 indicates a n-th division from the center division 81, the actual focal length f' is:

$$f'=kf$$

k−1+n (division n is positive on the right side in FIG. 4)

Numerals of k and n are indicators for representing the adjustment amount.

The adjustment-amount input means 1 supplies data corresponding to the indicator k or n. In accordance with the input indicator k or n, the driver control means (determining means) 2 determines the corrected drive amount $x_m'$ relative to a predetermined drive amount $x_m$ of the image-forming lens 10 at the time of a desired magnification of the driving means (variable power driving system) 40.

The corrected drive amount $x_m'$ is determined or calculated in the following manner.

In this embodiment, for the image-forming lens 10 having a desired focal length f', the movement amount of the image-forming lens 10 is corrected as:

$$x_m'=x_m\times S$$

At this time, the optical-path-length change amount $y_m'$ is automatically determined from the corrected drive amount $x_m'$, as represented by the relation (2), since the driving means 40 is connected to the image-forming lens 10 and the zoom-mirror unit 14. Here, the relations (5) and (6) become $$a_m'=2f'+x_m' \tag{5'}$$

$$b_m'=2f'-x_m'+y_m' \tag{6'}$$

$$y_m'=(x_m'-f+f^2/(x_m'+f))$$

Further, from the relation (7), the actual magnification m' is corrected as:

$$m'=\frac{2f'+f^2/(x_m'+f)-f}{2f'+x_m'} \tag{7'}$$

$$S=k \tag{8}$$

Since $x'=kx=kf(1/m-1)$ (9), the relation (7') becomes $$m'=\frac{2k+1/(k/m-k+1)-1}{2k+k/m-k}$$

A difference (magnification deviation) z between the desired magnification m (set magnification) and the actual magnification m' is given by:

$$z=(m'/m-1)\times 100(\%)$$

Figure 5:
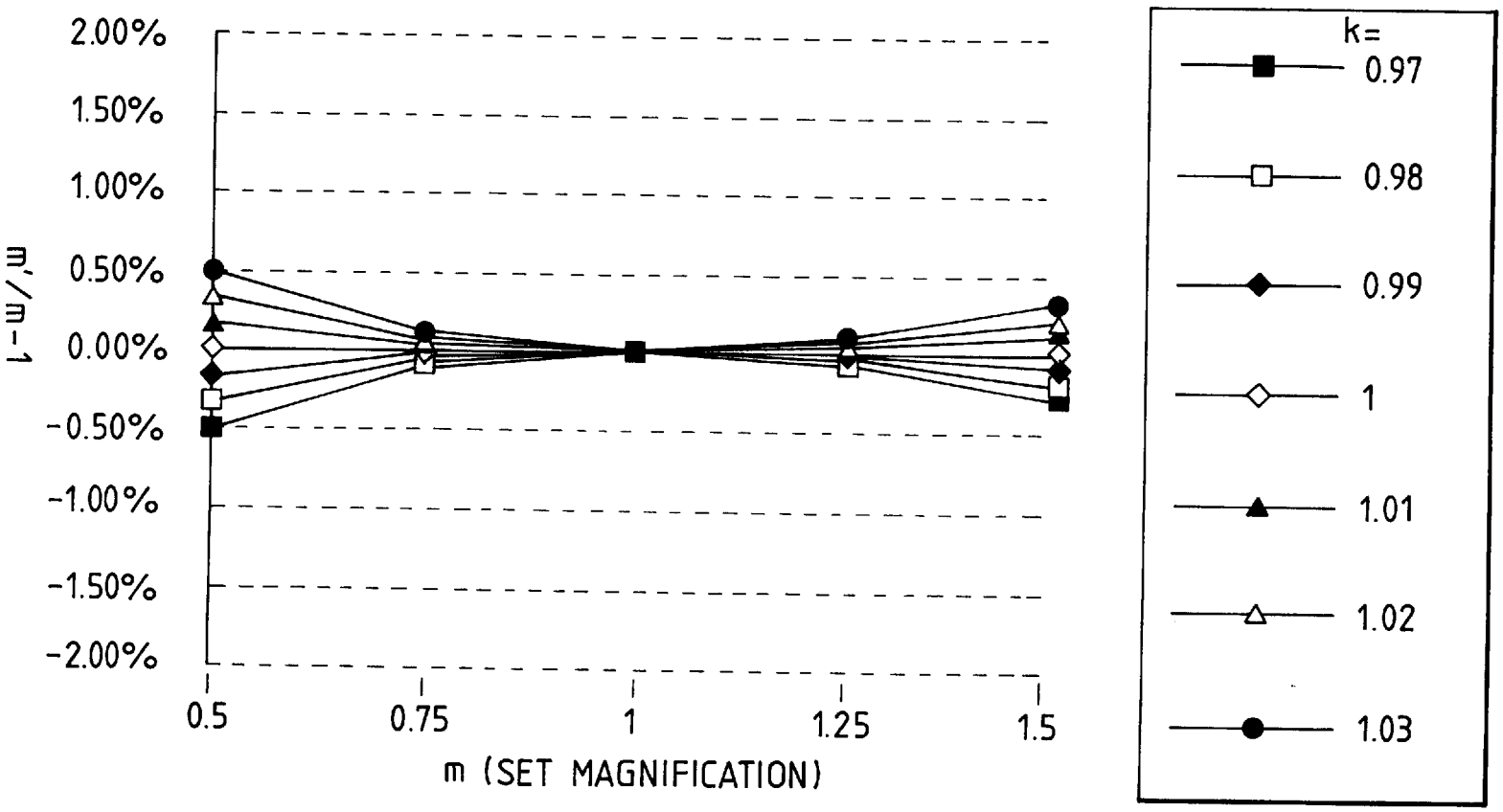
FIG. 5 is a representation illustrating magnification errors of the first embodiment.

The magnification deviation is expressed as illustrated in FIG. 5.

Figure 1:
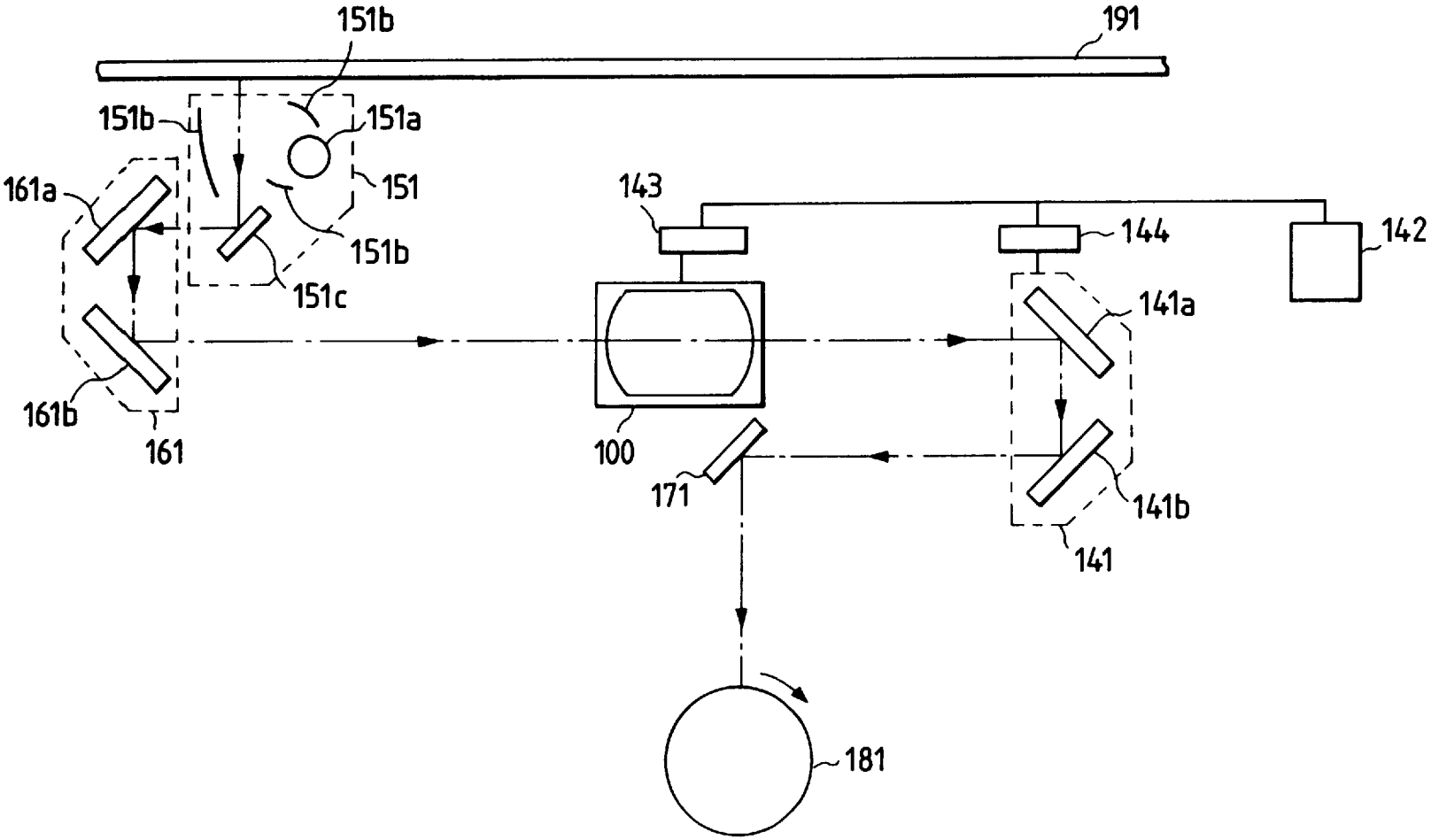
FIG. 1 PRIOR ART
FIG. 1 is a view illustrating a main portion of a conventional image-forming apparatus.
Figure 2:
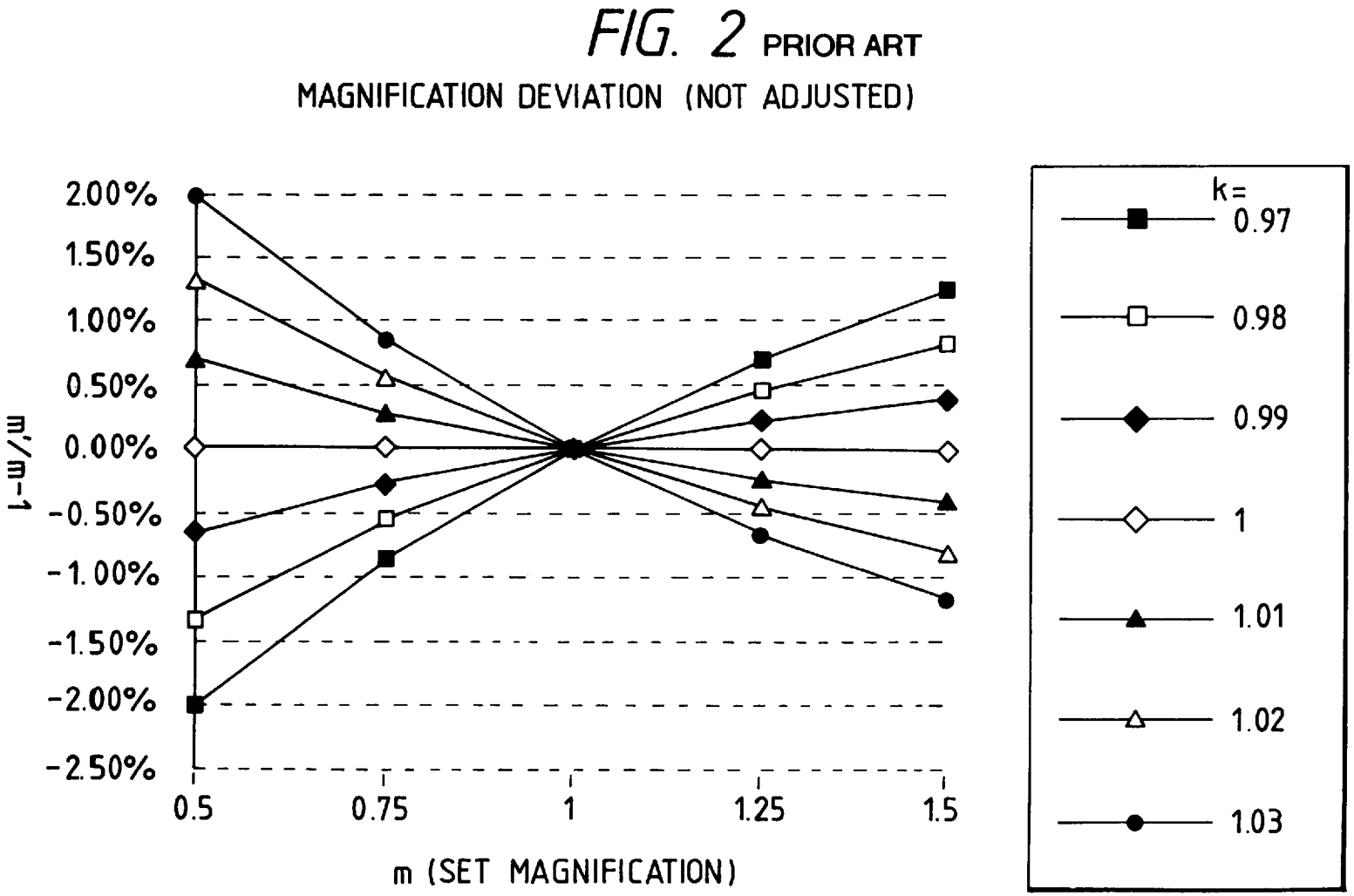
FIG. 2 PRIOR ART
FIG. 2 is a representation illustrating magnification errors of the conventional image-forming apparatus.

From the comparison between the magnification deviation (after adjusted) shown in FIG. 5 and the magnification deviation (not adjusted) shown in FIG. 2, it can be known that the magnification deviation can be reduced to about a fourth (¼) in this embodiment.

There are several methods for determining the corrected drive amount $x_m'$, as follows, (1) A memory means (recording means) for recording the indicator k or n is provided, and the corrected drive amount $x_m'$ corresponding to the indicator k or n is read from a memory table prepared beforehand, such as a ROM, each time needed.

(2) A memory means for recording the indicator k or n is provided, and the corrected drive amount $x_m'$ corresponding to the indicator k or n is calculated each time needed.

(3) The corrected drive amount $x_m'$ corresponding to the indicator k or n is determined by the determining means (operation unit), such as an external jig tool, is recorded in a memory table (recording means such as a ROM) arranged in a body, and is read each time needed.

Conventional means, such as a ROM and a resistance value of a variable resistor, can be used as the memory means. In the case of (3), the element 1 in FIG. 3 is the external determining means (operation unit), and information of the drive amount determined by the determining means 1 is input into the driver control means (CPU) 2 in the body and recorded in the memory means (recording means).

Thus, when the determining means is provided separately from the apparatus body and used as an assemblage jig tool, there is no need to arrange the means for determining the corrected drive amount in the apparatus body. Thus, its cost can be reduced.

In this embodiment, the division indicators 8 and the reference indicator 9 are respectively provided on the connecting plate 6 and the lens unit frame 101, but when those indicators are respectively marked as nicks in the connecting plate 6 and the lens unit frame 101, the number of parts can be reduced.

Thus, when the positions of the image-forming lens 10 and the zoom-mirror unit 14 are changed along the optical axis as discussed above to vary the magnification to a desired value, the positions of the image-forming lens 10 and the zoom-mirror unit 14 on the optical axis are finely adjusted by the fine adjustment means to satisfy a predetermined magnification and the focussing and the relative adjustment amount between the driving means 40 and the image-forming lens 10 or the zoom-mirror unit 14 subsequent to the fine adjustment is detected by the detecting means. The thus-detected adjustment amount is input into the input means 1, and the determining means 2 determines the drive amount (corrected drive amount) $x_m'$ of the driving means 40 on the basis of the thus-input adjustment amount. The correction is made by moving the positions of the image-forming lens 10 and the zoom-mirror unit 14 on the basis of the determined information such that the predetermined magnification (set magnification) approximately coincides with the actual magnification. Accordingly, an appropriately focused image can be obtained even when the focal length of the image-forming lens 10 fluctuates due to errors during the manufacturing process.

A second embodiment of the present invention will be described. In the second embodiment, as the means for determining the corrected drive amount $x_m'$, the following relations are substituted into the relation (7') explained in the first embodiment:

$$m'=m \tag{10}$$

$$f'=kf$$

$$x'=Sx=S\cdot f(1/m-1)$$

Thus, $$2kf+\frac{f^2}{(Sx+f)}-f=(2kf+Sx)m$$

$$(2k+1)+\frac{1}{S(1/m-1)+1}=[2km+S(1-m)]$$

$$(2k-1)(S(1-m)+m=[2km+S(1-m)+m]$$

$$(2k-1)(1-m)s+2km=(1-m^2S^2+(2k+1)m(1-m)S+2km^2$$

$$(1-m^2S^2+[2k(m-1)+(m+1)]\cdot(1-m)S+2km(m-1)=0$$

$$(1-m)S^2+[2k(m-1)+(m+1)]S'-2km=0$$

$$S_m=\frac{2k(1-m)-(m+1)+\sqrt{(2k-1)^2(m-1)^2+4m}}{2(1-m)}$$

$(m\neq 1)$ (because $S<0$)

By using this S, the corrected drive amount $x_m'$ is obtained as:

$$x'=x_m\times S$$

$x_m$: drive amount from a one-to-one magnification to a magnification of m $$k=(L+\Delta L)/L$$

$$L=2\times f$$

$\Delta L$=difference in relative position between the image-forming lens and the driving means from a design value f=focal length of the image-forming lens Hence, the actual magnification m' becomes equal to the desired magnification (set magnification) m, as expressed in the relation (10). Thus, still more accurate correction can be made in the second embodiment, compared with the first embodiment.

Figure 6:
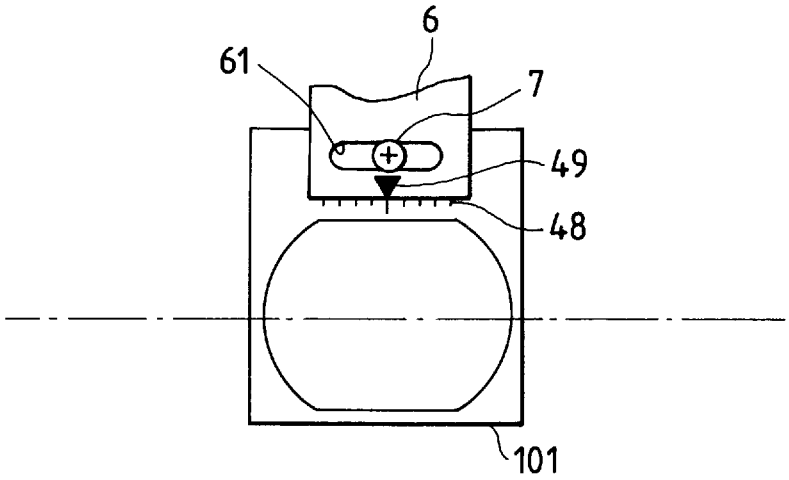
FIG. 6 is an enlarged view illustrating coupling portions of a third embodiment according to the present invention.

FIG. 6 illustrates coupling portions of a third embodiment of the present invention. The third embodiment is different from the first embodiment (FIG. 4) in that a reference indicator 49 is marked on the connecting plate 6 while division indicators 48 are marked on the frame 101. Other structure and optical operation of the third embodiment are substantially the same as those of the first embodiment, and thus the same effects are obtained.

Specifically, the divisions 48 are notched at a pitch of P mm/division in this embodiment. In this case, when the reference indicator 49 indicates a division of n' (the division of n' is positive on the left side in FIG. 6), the reduction is executed as follows:

$$n=n'P/2f \text{ or } k=2f+n'P/2f$$

Thus, S is calculated by the above-discussed calculation method.

Figure 7:
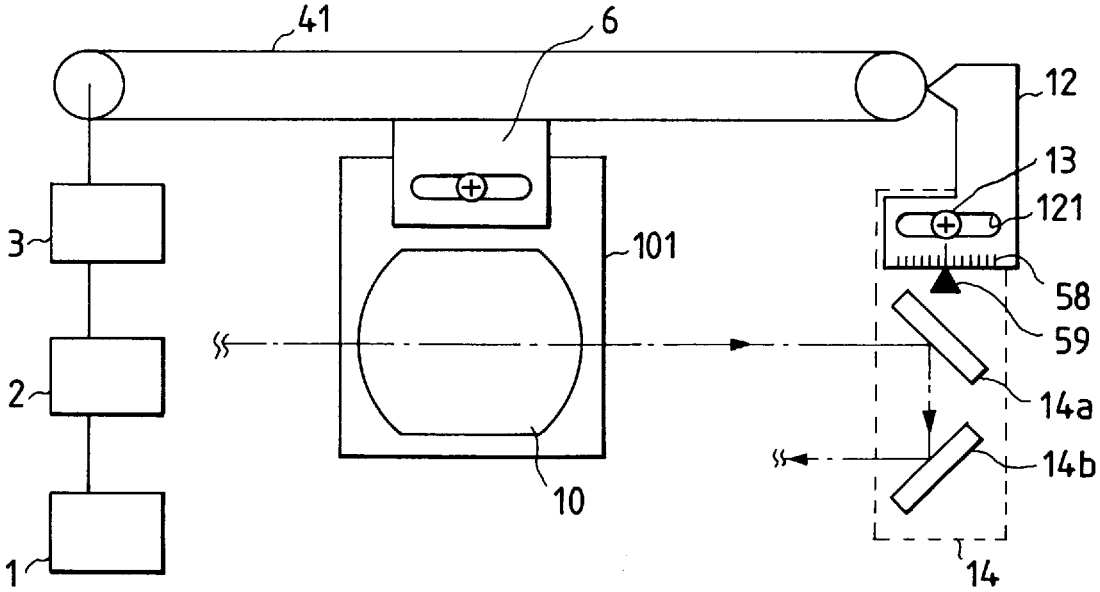
FIG. 7 is a view illustrating a main portion of a fourth embodiment according to the present invention.

FIG. 7 illustrates a main portion of a fourth embodiment of the present invention. In FIG. 7, the same elements as those in FIG. 4 are designated by the same numbers.

The fourth embodiment is different from the first embodiment (FIG. 4) in that a reference indicator 59 is marked on the zoom-mirror unit 14 while division indicators 58 are marked on the cam follower 12. The division pitch P, other structure and optical operation of the fourth embodiment are substantially the same as those of the first embodiment, and thus the same effects are obtained.

More particularly, as is known from the relations (3) and (4), where the focal length f at the time of design is changed to the actual focal length f' (f→f'), fine adjustment amounts xA and yA of the image-forming lens and the zoom-mirror unit at the time of a magnification of m=1 are respectively given by:

$$xA=2(f'-f)$$

$$yA=2(f'-f)$$

Thus, those values are equal. Therefore, even when the reference indicator 59 is provided on the zoom-mirror unit 14 and the division indicators 58 are put on the cam follower 12, this embodiment can be treated equivalently to the first embodiment.

Even when the reference indicator 59 is notched on the cam follower 12 and the division indicators 58 are notched on the zoom-mirror unit 14, the present invention can also be applied, similar to the fourth embodiment.

Figure 8:
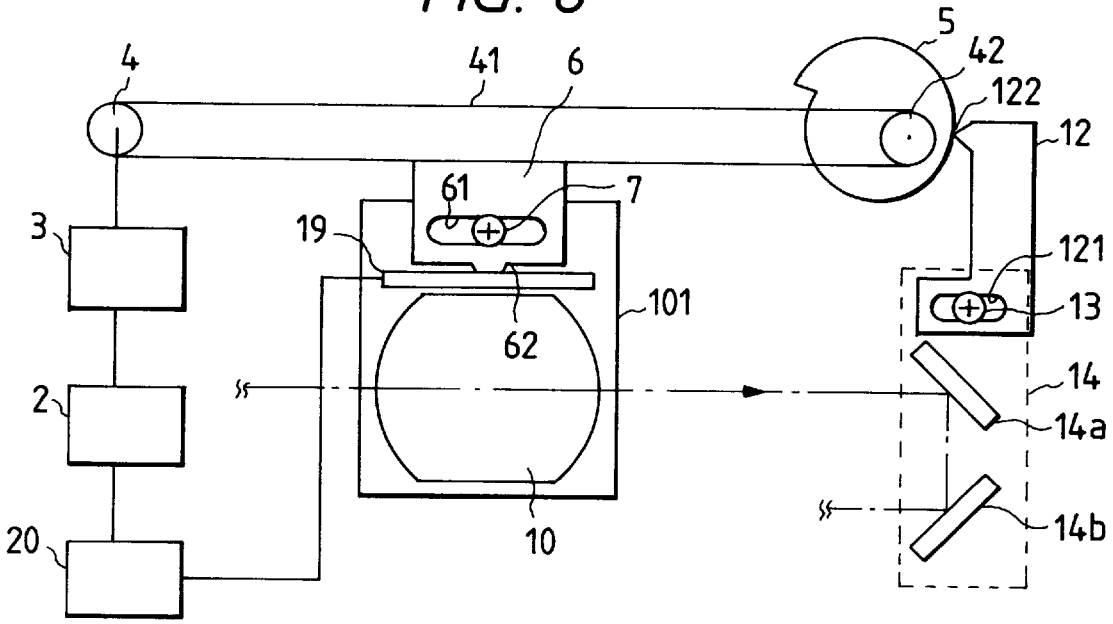
FIG. 8 is a view illustrating a main portion of a fifth embodiment according to the present invention.

FIG. 8 illustrates a main portion of a fifth embodiment of the present invention. In FIG. 8, the same elements as those in FIG. 4 are designated by the same numbers.

The fifth embodiment is different from the first embodiment (FIG. 4) in that in place of the reference indicator and the division indicators, there are arranged a linear sensor 19 for detecting the displacement amount of a flag plate 62 attached to the connecting plate 6 and an operation circuit (operation means) 20 for calculating the adjustment amount of the fine adjustment means from the output value of the linear sensor 19. Other structure and optical operation of the fifth embodiment are substantially the same as those of the first embodiment, and thus the same effects are obtained.

The flag plate 62 and the linear sensor 19 constitute a portion of a position detecting means, and detect a change in the relative position between the image-forming lens 10 and the driving means. Namely, the displacement amount of the image-forming lens 10 relative to the driving means is detected. The operational means 20 calculates the adjustment amount of the fine adjustment means on the basis of the output value of the position detecting means.

An adjustment method for varying the magnification of this embodiment will be described.

Initially, the image-forming lens 10 and the mirror unit 14 are respectively fixed to the driving means.

The driving source 3 is then driven by the driver control means 2, and the connecting plate 6 and the eccentric cam 12 are moved to the arrangement at the time of a one-to-one magnification. Then, the set screws 7 and 13 are respectively unscrewed and the positions of the image-forming lens 10 and the zoom-mirror unit 14 are finely adjusted along the optical axis. The respective screws 7 and 13 are tightened at places where the conditions of magnification and focussing are satisfied.

Then, the position of the flag plate 62 is detected by the linear sensor 19. The detection value detected by the linear sensor 19 is converted into the adjustment amount k by the operation circuit 20. For this purpose, a data table of the detection value and the adjustment amount k is produced in the operation circuit 20 beforehand, and those are corresponded to each other.

Then, the corrected drive amount $x_m'$ of the image-forming lens is determined from the adjustment amount k, by the same calculating method as that of the first or second embodiment. Thus, the same effects as those of the above-discussed embodiments can be obtained.

The position detecting means of this embodiment can automatically detect the actual focal length f'. Therefore, when adjustments of focussing and magnification are performed at a predetermined magnification, corrections at other magnifications can be automatically achieved.

Figure 9:
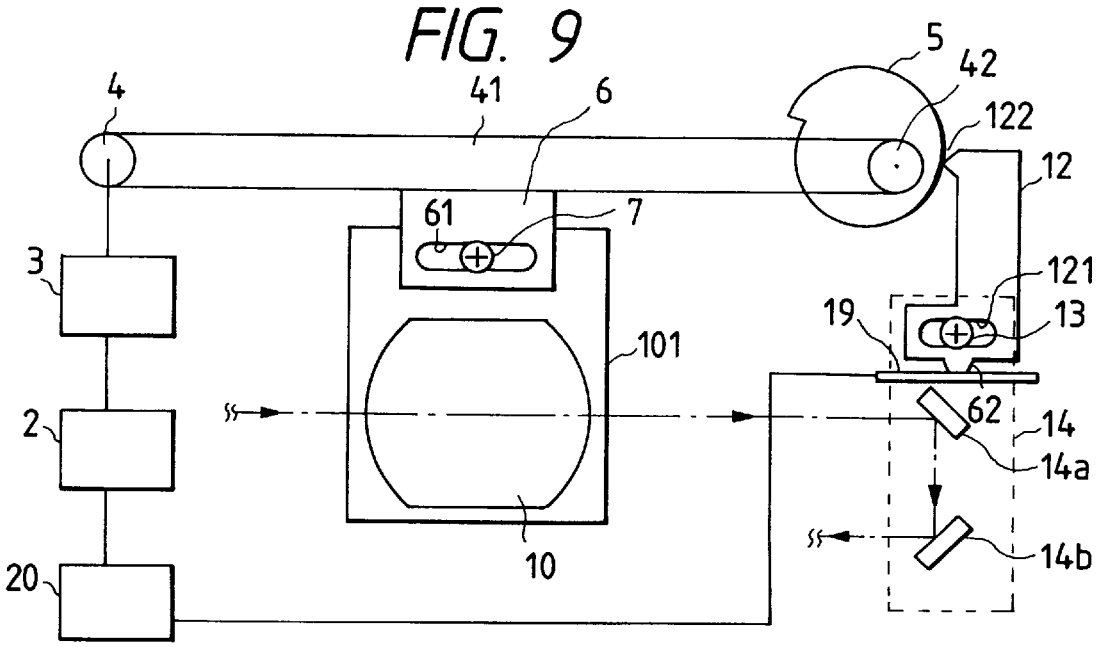
FIG. 9 is a view illustrating a main portion of a sixth embodiment according to the present invention.

Further, FIG. 8 illustrates an example in which the displacement amount of the image-forming lens is detected by the linear sensor, but the same effects can also be obtained by detecting the displacement amount of the mirror unit as illustrated in FIG. 9.

As described in the foregoing, in an image-forming apparatus and a magnification correction method using this apparatus according to the present invention, correcting means and method are used to obtain a proper magnification even if the focal length of an image-forming lens fluctuates due to errors occurring during the manufacturing process. Therefore, the following effects or technical advantages can be attained.

(1) Adjustment of the magnification can be readily performed, and magnification accuracy is improved.

(2) Assemblage efficiency is improved.

(3) No complex input structure is needed, so that the number of parts can be reduced and the structure can be compact in size.

(4) A driving source can be reduced, so that the entire structure can be small in size, cost thereof can be reduced and noises thereof can be lowered.

What is claimed is:

1. An image-forming apparatus comprising:

image-forming means for image-forming image information of an original on a record medium, said image-forming means including an image-forming lens having a fixed focal point;

optical-path-length varying means for varying a distance between an object and an image, wherein said optical-path-length varying means includes a plurality of mirrors and is disposed in an optical path between said image forming means and the record medium;

a mirror disposed in an optical path between said optical-path-length varying means and the record medium;

driving means for driving said image-forming means and said optical-path-length varying means in an interlocking manner such that the image information of the original is formed on the record medium at a plurality of magnifications, the positions of said image-forming means and said optical-path-length varying means are adjustable relative to said driving means, and the positions of said image forming means and said optical-path-length varying means are adjustable in a direction of an optical axis; and control means for controlling said driving means.

2. An image-forming apparatus comprising:

image-forming means for image-forming image information of an original on a record medium;

optical-path-length varying means for varying a distance between an object and an image;

driving means for driving said image-forming means and said optical-path-length varying means in an interlocking manner such that the image information of the original is formed on the record medium at a plurality of magnifications, and the positions of said image-forming means and said optical-path-length varying means are adjustable relative to said driving means;

control means for controlling said driving means; and a coupling portion between said driving means and said image-forming means and an indicator for positional adjustment therebetween provided on said coupling portion.

3. An image-forming apparatus comprising:

image-forming means for image-forming image information of an original on a record medium;

optical-path-length varying means for varying a distance between an object and an image;

driving means for driving said image-forming means and said optical-path-length varying means in an interlocking manner such that the image information of the original is formed on the record medium at a plurality of magnifications, and the positions of said image-forming means and said optical-path-length varying means are adjustable relative to said driving means;

control means for controlling said driving means; and a coupling portion between said driving means and said optical-path-length means and an indicator for positional adjustment therebetween provided on said coupling portion.

4. An image-forming apparatus comprising:

image-forming means for image-forming image information of an original on a record medium, said image-forming means including an image-forming lens having a fixed focal point;

optical-path-length varying means for varying a distance between an object and an image, wherein said optical-path-length varying means includes a plurality of mirrors and is disposed in an optical path between said image forming means and the record medium;

a mirror disposed in an optical path between said optical-path-length varying means and the record medium;

driving means for driving said image-forming means and said optical-path-length varying means in an interlocking manner such that the image information of the original is formed on the record medium at a plurality of magnifications, the positions of said image-forming means and said optical-path-length varying means are adjustable relative to said driving means, and the positions of said image forming means and said optical-path-length varying means are adjustable in a direction of an optical axis;

detecting means for detecting a change in a relative position between said driving means and said image-forming means or said optical-path-length varying means; and control means for controlling said driving means on the basis of a detection result of said detecting means.

5. An image-forming apparatus comprising:

image-forming means for image-forming image information of an original on a record medium, said image-forming means including an image-forming lens having a fixed focal point;

optical-path-length varying means for varying a distance between an object and an image, wherein said optical-path-length varying means includes a plurality of mirrors and is disposed in an optical path between said image forming means and the record medium;

a mirror disposed in an optical path between said optical-path-length varying means and the record medium;

driving means for driving said image-forming means and said optical-path-length varying means in an interlocking manner such that the image information of the original is formed on the record medium at a plurality of magnifications, the positions of said image-forming means and said optical-path-length varying means are adjustable relative to said driving means, and the positions of said image forming means and said optical-path-length varying means are adjustable in a direction of an optical axis; and control means for controlling said driving means on the basis of a change in a relative position between said driving means and said image-forming means or said optical-path-length varying means.

6. A magnification correction method in an image-forming apparatus for image-forming image information of an original on a record medium, the apparatus including a fixed focus image forming means including a plurality of mirrors, optical-path-length varying means, and a mirror disposed in an optical path between the fixed focus image forming means and the optical-path-length varying means, said method comprising the steps of:

driving the fixed-focus image-forming means and the optical-path-length varying means in an interlocking manner by a common driving means such that image information of the original is formed on the record medium at a plurality of magnifications;

adjusting positions of the image-forming means and the optical-path length means relative to the driving means and in a direction of an optical axis;

detecting a change in a relative position between the driving means and the image-forming means or the optical-path-length varying means; and controlling the driving means on the basis of the change detected in said detecting step.

7. A magnification correction method in an image-forming apparatus for image-forming image information of an original on a record medium, the apparatus including a fixed focus image forming means including a plurality of mirrors, optical-path-length varying means, and a mirror disposed in an optical path between the fixed focus image forming means and the optical-path-length varying means, said method comprising the steps of:

driving the fixed-focus image-forming means and the optical-path-length varying means in an interlocking manner by a common driving means such that image information of the original is formed on the record medium at a plurality of magnifications;

adjusting positions of the image-forming means and the optical-path length means relative to the driving means and in a direction of an optical axis; and controlling the driving means on the basis of a change in a relative position between the driving means and the image-forming means or the optical-path-length varying means.

* * * * *

UNITED STATES PATENT AND TRADEMARK OFFICE

CERTIFICATE OF CORRECTION

PATENT NO. : 5,809,381

DATED : September 15, 1998

INVENTOR(S): KAZUMI KIMURA

It is certified that error appears in the above-identified patent and that said Letters Patent is hereby corrected as shown below:

ON COVER PAGE [56], REFERENCES CITED, FOREIGN PATENT DOCUMENT

"4348334" should read --4-348334--.

COLUMN 3

Line 3, "Is" should read --is--.

COLUMN 5

Line 40, "record-medium" should read --record medium--.

COLUMN 8

Line 4, "ΔL-difference Zin" should read --ΔL=difference in--;
Line 40, "mirror-15C," should read --mirror 15c,--.

COLUMN 11

Line 53, "K-1+n"" should read --K=1+n--.

COLUMN 12

Line 25, "x'=kx=kf(1/m-1)(9)," should read
--x'=kx=kf(1/m-1) (9),--.

UNITED STATES PATENT AND TRADEMARK OFFICE

CERTIFICATE OF CORRECTION

PATENT NO. : 5,809,381

DATED : September 15, 1998

INVENTOR(S): KAZUMI KIMURA

It is certified that error appears in the above-identified patent and that said Letters Patent is hereby corrected as shown below:

COLUMN 13

Line 54, "(2k-1)(S(1-m)+m=[2km+S(1-m)+m]" should read --(2k-1)[S(1-m)+m]+m=[2km+S(1-m)][S(1-m)+m]--;

Line 55, "(2k-1)(1-m)s+2km=(1-$m^2S^2$+(2k+1)m(1-m)S+2$km^2$" should read --(2k-1)(1-m)s+2km=$(1-m)^2S^2$+(2k+1)m(1-m)S+2$km^2$--;

Line 56, "(1-$m^2S^2$+[2k(m-1)+(m+1)]·(1-m)S+2km(m-1)=0" should read --$(1-m)^2S^2$+[2k(m-1)+(m+1)]·(1-m)S+2km(m-1)=0--;

Line 60, "Sm=" should read --S=--.

COLUMN 17

Line 17, "image forming" should read --image-forming--.

UNITED STATES PATENT AND TRADEMARK OFFICE

CERTIFICATE OF CORRECTION

PATENT NO. : 5,809,381

DATED : September 15, 1998

INVENTOR(S): KAZUMI KIMURA

It is certified that error appears in the above-identified patent and that said Letters Patent is hereby corrected as shown below:

COLUMN 18

Line 19, "optical-path length" should read --optical-path-length varying--;
Line 41, "optical-path length" should read --optical-path-length varying--.

Signed and Sealed this

Seventh Day of September, 1999

*Attest:*

Q. TODD DICKINSON

*Attesting Officer*

*Acting Commissioner of Patents and Trademarks*